United States Patent [19]

Duffy

[11] Patent Number: 4,507,066

[45] Date of Patent: Mar. 26, 1985

[54] FLUID EXPANSION DEVICE

[76] Inventor: James T. Duffy, 247 Salisbury Sq., Louisville, Ky. 40207

[21] Appl. No.: 540,335

[22] Filed: Oct. 11, 1973

Related U.S. Application Data

[63] Continuation-in-part of Ser. No. 349,858, Feb. 18, 1982, abandoned.

[51] Int. Cl.[3] ..... F01C 1/22; F01C 21/04

[52] U.S. Cl. ..... 418/61 A; 418/94

[58] Field of Search ..... 418/61 A, 91, 94, 61 B

[56] References Cited

U.S. PATENT DOCUMENTS

| | | | |
|---|---|---|---|
| 3,221,664 | 12/1965 | Jernaes | 418/61 B |
| 3,762,842 | 10/1973 | George | 418/61 A |
| 3,846,053 | 11/1974 | Roberts | 418/94 |
| 3,854,849 | 12/1974 | Brille | 418/61.3 |
| 3,907,464 | 9/1975 | Mitchell | 418/61 A |
| 4,297,090 | 10/1981 | Hoffman | 418/61 A |

FOREIGN PATENT DOCUMENTS

| | | | |
|---|---|---|---|
| 1201605 | 9/1965 | Fed. Rep. of Germany | 418/91 |
| 601443 | 4/1978 | U.S.S.R. | 418/91 |

OTHER PUBLICATIONS

Van Wyler, G. and Sonntag, R., *Fundamentals of Classical Thermodynamics,* 1937, NY, John Wiley & Sons, pp. 184–185.

*Primary Examiner*—John J. Vrablik

*Assistant Examiner*—T. Olds

*Attorney, Agent, or Firm*—Edward M. Steutermann

[57] ABSTRACT

A trochoid-type rotary piston gas expansion device including a stationary housing and endwalls defining an epitrochoidal cavity closing where the cavity is symmetrical about a first axis transverse to the end walls, a rotatable crank shaft extending through the cavity parallel to the first axis, and having an eccentric portion located on the shaft in the cavity, a rotary piston mounted on the eccentric portion of the shaft so that the axial centerline of the piston describes a circular path of selected diameter during rotation thereof where the rotary piston includes flank surfaces which intersect at apices to determine lines of sealing contact with the walls of the cavity. At least two inlets are provided to the stationary housing to admit a compressed/expandable fluid into the chamber defined between the trochoidal cavity and a surface of the piston where the piston is in a first segment of its arc of rotation and outlets from the cavity for emission of fluid from the stationary housing when the piston is in a selected position in its arc of rotation. A rotary valve member is provided outside the housing to be rotated by the shaft having a valve port communicating with a supply of compressed fluid and periodically coming in alignment with the inlet to the chamber to sequentially open and close the inlet to the chamber for selected periods to selectively regulate the amount of fluid admitted to the chamber in accordance with the position of the piston surface.

6 Claims, 9 Drawing Figures

FLUID EXPANSION DEVICE

BACKGROUND OF THE INVENTION

This application is a continuation in part of my copending application Ser. No. 349,858, filed Feb. 18, 1982, now abandoned.

The present invention relates to devices for recovery of useful work energy from the expansion of compressed fluids.

Devices within the scope of the present invention are useful in the recovery of work energy from compressed fluids, for example natural gas, where it is necessary to reduce the pressure of the fluid for use of the fluid in subsequent operations. In such applications the pressure reduction is presently accomplished by means that either do not provide useful energy or which require energy for the pressure reduction.

Also, various prior art means are known for obtaining useful energy through pressure reduction. The most common such being turbines or other such devices which are intended to provide useful energy from steam or other high pressure fluids where the pressure is reduced in passing through the device and generally operate with high temperature working fluid.

One expansion device of the trochoid-type rotary piston arrangement is shown in U.S. Pat. No. 4,047,856 Huffmann, where the fluid/steam, to be reduced in pressure is transmitted through the rotor to bridging passage means terminating in the working areas of the device.

A second device is shown in U.S. Pat. No. 4,297,090 Huffmann where a rotating valve plate is provided inside an epitrochoidal cavity which is fixed to the piston and rotates in a planetory path to periodically come into alignment with an inlet provided in one endwall of the cavity where a recess is required on the valve plate. In the Huffman device the gas enters parallel to the axis of rotation of the rotor and then expands into the chamber formed by the cavity and its rotor.

In general, prior art trochoid devices require the reversal or sharp change in the direction of flow of fluid through the device and are thus less efficient than devices where the fluid flows through the device without reversal. Further, such prior art devices do not take advantage of the kinetic energy of the gasses admitted to the chamber.

While trochoid-type devices are suitable for expansion of gasses, and are particularly useful in providing controlled expansion the adaptation of such prior art devices has been limited by difficulties in providing means for introduction of the pressurized fluid and providing efficient sealing to avoid power loss.

Moreover, no prior art device is known which can be utilized for expansion of gasses over a wide range of temperature to efficiently reclaim energy and particularly no prior art device is known which can be utilized for expansion of low temperature gauge gas or where flow of the gas through the device is not reversed.

SUMMARY OF THE INVENTION

The present invention provides positive displacement and controlled expansion trochoidal type rotary piston devices for pressure reduction where the efficiency of the device is improved to reclaim substantial portions of the energy present in the fluids and emit the fluid at a lower pressure and eliminate many of the sealing problems inherent in devices of the type described in U.S.

Pat. Nos. 4,047,856 and 4,297,090 and particularly provide means to modify the gas flow path to obtain the benefits of selectively directing gas flow and avoid the disadvantage of turning the gas flow path too quickly.

More particularly the present invention provides a positive displacement device utilizing the rotary trochoid principal to reduce high pressure gas to lower pressures by controlled expansion to produce useful shaft horse power as well as the refrigeration effect which is a product of the gas expansion. In accordance with the present invention high pressure inlet ports and low pressure exhaust ports are provided in the periphery of the rotor housing to provide isolation of the cavities of the device as the rotor turns in the housing and the gas inlets and outlets are positioned to permit maximum recovery of energy. In a dual lobe device with a three sided rotor the present invention provides two high pressure charges per revolution of the crank shaft where the inlet and exhaust port sizes are easily sized to accommodate different working pressures and fluids.

In the prior art the seal between the alternating high pressure and low pressure chambers of the trochoidal device have been accomplished by use of mechanical seals at the peripherical edge of the piston. Such mechanical seals have generally not been satisfactory because of the normal wear, further complicated by the expansion and contraction of the working parts as a result of temperature differentials which normally occur in such devices.

Further it has been found that devices within the scope of the present invention can be designed to provide for uniform expansion and contraction of the elements of the device in response to temperature change, for example the cooling experienced in the expanding gases and allows the elimination of the apex and lateral mechanical seals required in prior art trochoidal devices by the use of controlled viscosity lubrication oil compatible with the operating temperature and the desired clearance between the rotor, the housing and the side plates to provide the seal between the higher pressure and lower pressure cavities of the device.

Further, in one application, devices within the scope of the present invention have been found particularly useful in the conversion of waste heat to useful mechanical energy by the use of an intermediate vaporizable working fluid such as, fluorinated hydrocarbons or ammonia.

More particularly, the present invention provides a trochoid-type rotary piston gas expansion device including a stationary housing and endwalls defining an epitrochoidal cavity closing where the cavity is symetrical about a first axis transverse to the end walls, a rotatable crank shaft extending through the cavity parallel to the first axis, and having an eccentric portion located on the shaft in the cavity, a rotary piston mounted on the eccentric portion of the shaft so that the axial centerline of the piston describes a circular path of selected diameter during rotation thereof where the rotary piston includes flank surfaces which intersect at apices to determine lines of sealing contact with the walls of the cavity. At least two inlets are provided to the stationary housing to admit a compressed/expandable fluid into the chamber defined between the trochoidal cavity and a surface of the piston where the piston is in a first segment of its arc of rotation and outlets from the cavity for emission of fluid from the stationary housing when the piston is in a selected position in its arc of rotation. A rotary valve member is provided outside the housing to be rotated by the shaft having a valve port communicating with a supply of compressed fluid and periodically coming in alignment with the inlet to the chamber to sequentially open and close the inlet to the chamber for selected periods to selectively regulate the amount of fluid admitted to the chamber in accordance with the position of the piston surface.

One example in accordance with the present invention is illustrated in the accompanying drawings. It will be understood that the illustrations presented herewith are by way of example only and that various other arrangements also within the scope of the present invention will occur to those skilled in the art upon reading the disclosures set forth hereinafter.

DETAIL DESCRIPTION OF THE DRAWINGS

Figure 1:
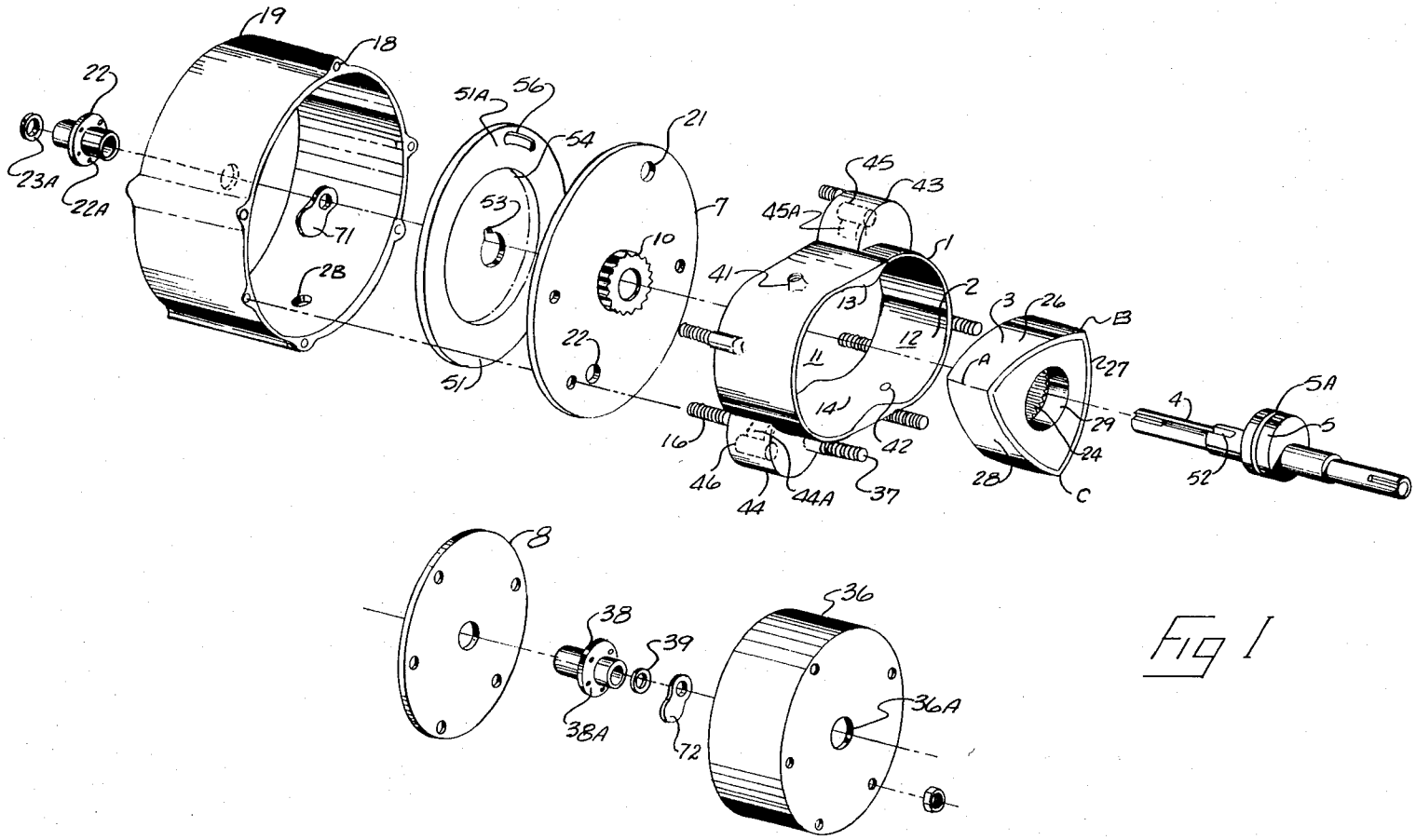
FIG. 1 is an exploded perspective view of one arrangement within the scope of the present invention.
Figure 2:
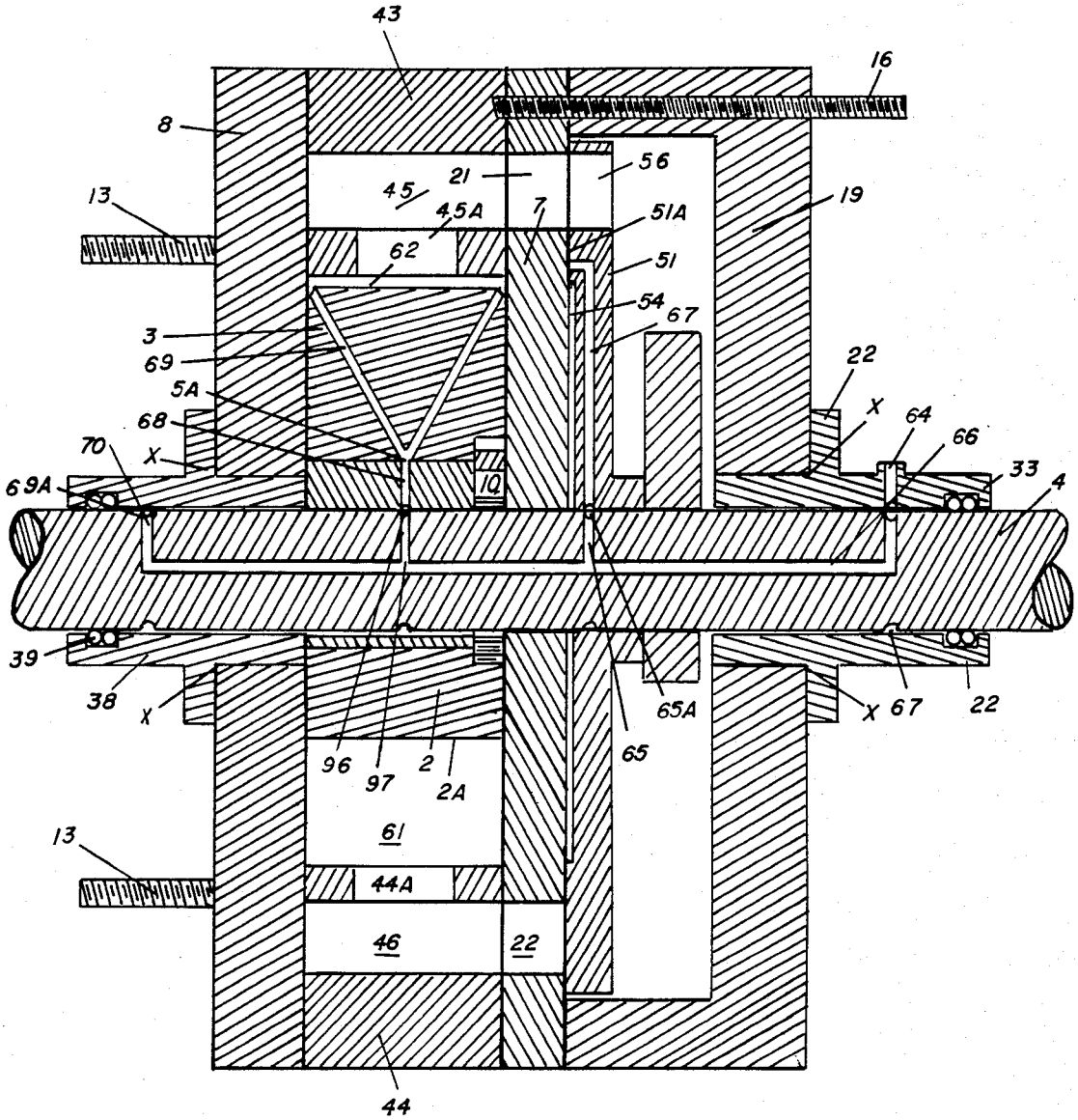
FIG. 2 is an elevation view and cross section of an assembled device as shown in FIG. 1.

Referring to FIG. 1 a housing 1 is shown having an epitrochoidal cavity 2 including 2 lobes 11 and 12 as is known in the art. A rotor 3 is provided to be received in lobes 11 and 12 and further adapted to receive a crank shaft 4. Crank shaft 4 carries an eccentric lobe 5. A circumferential groove 5A can be provided in the periphery of rotor 5. Internal conduits 68, 69 as shown in FIG. 2 can also be provided in shaft 4 and lobe 5 to communicate with grooves 5A. Also a central conduit 66 can be provided in shaft 14 to communicate with conduit 68 as described hereinafter.

A pair of end walls 7 and 8 are provided to be received on opposite sides of housing 1 to define sidewalls of cavity 2. Cavity 2 is generally symetrical with respect to the axis of shaft 4. As is known in the art, cavity 2 includes a pair of epitrochoidal lobes 11 and 12 which intersect at lobe junctions 13 and 14 to define the minor axis of the housing. Endwalls 7 and 8 are secured to housing 1 and in the example shown bolts 16 are provided in to be received through cooperative apertures of sidewall 7 and extend therethrough to be received in apertures 18 of a pressure cap 19 to secure the entire arrangement. Likewise bolts 37 are provided by housing 1 to extend through cooperative apertures of endwalls 8 and on exhaust cap 36 to secure the arrangement.

An inlet 2B is provided in cap 19 for admission of high pressure fluid to the device.

Shaft 4 is mounted within end cap 19 in a bearing endplate 22 which can be secured to the sidewall of cap 19 by bolts or other suitable means received in flange 22A. Seals, for example, O rings 23 can be provided within bearing 22 to seal the shaft.

Shaft 4 includes an eccentric member 5 as previously described having a generally cylindrical outer surface which is circular in transverse section and is concentric about a second axis parallel to and selectively spaced from the axis of shaft 4. As is known in the art the offset between the second axis and the axis of the crankshaft determines the eccentricity of the rotor in its rotation in housing 1.

Rotor 3 is symetrical about its axis, as is known in the art so that rotor 3 and eccentric 5 are concentric with their center axis being regularly displaced from the longitudinal axis of the power shaft 4 a selected distance to provide an orbital rotation diameter.

Rotor 3 includes a plurality of smooth epitrochoidal flank surfaces 26–28 which intersect at apices A, B, C. The apices A, B and C, the surfaces 26–28 and the walls of housing 1 define a plurality of moving fluid expansion chambers within the cavity of housing 1 as rotor 3 turns, as is known in the art. An inner cylindrical surface 29 is provided within rotor 3 to support rotor on the eccentric 5 of shaft 4 for rotation. Rotor 3 is provided with opposite generally parallel facing surfaces which are disposed to engage the inner surface of end walls 7 and 8 to provide a seal therebetween, as described hereinafter. In assembled form three chambers are defined within housing 1 by the inner walls of cavity 2 and the flank surfaces 26, 27 and 28 of rotor 3. A second cap 36 can be provided at the end of housing 1 opposite housing 19 and can be secured to endwall 8 by means of bolts 37 carried by housing 1. A second bearing 38 is provided to be secured to endwall 8, by means of bolts or other suitable means to journal the second end of shaft 4 and can include "O" ring seals 39 to seal on shaft 4.

Housing 1 includes gas exhaust 41 and 42 in appropriate position within the housing as determined by the characteristics of the operation of the device. Gas inlets are provided in lobes 43 and 44 of housing 1 which are diametrically opposed through a centerline of shaft 4. Each of the inlet lobes 43 and 44 includes an inlet port 45, 46 respectively for admission of fluid and conduits 44A–45A respectfully connecting the inlet 45–46 with the inside of chamber 2 as shown in FIGS. 2 and 3A–3C.

Figure 5:
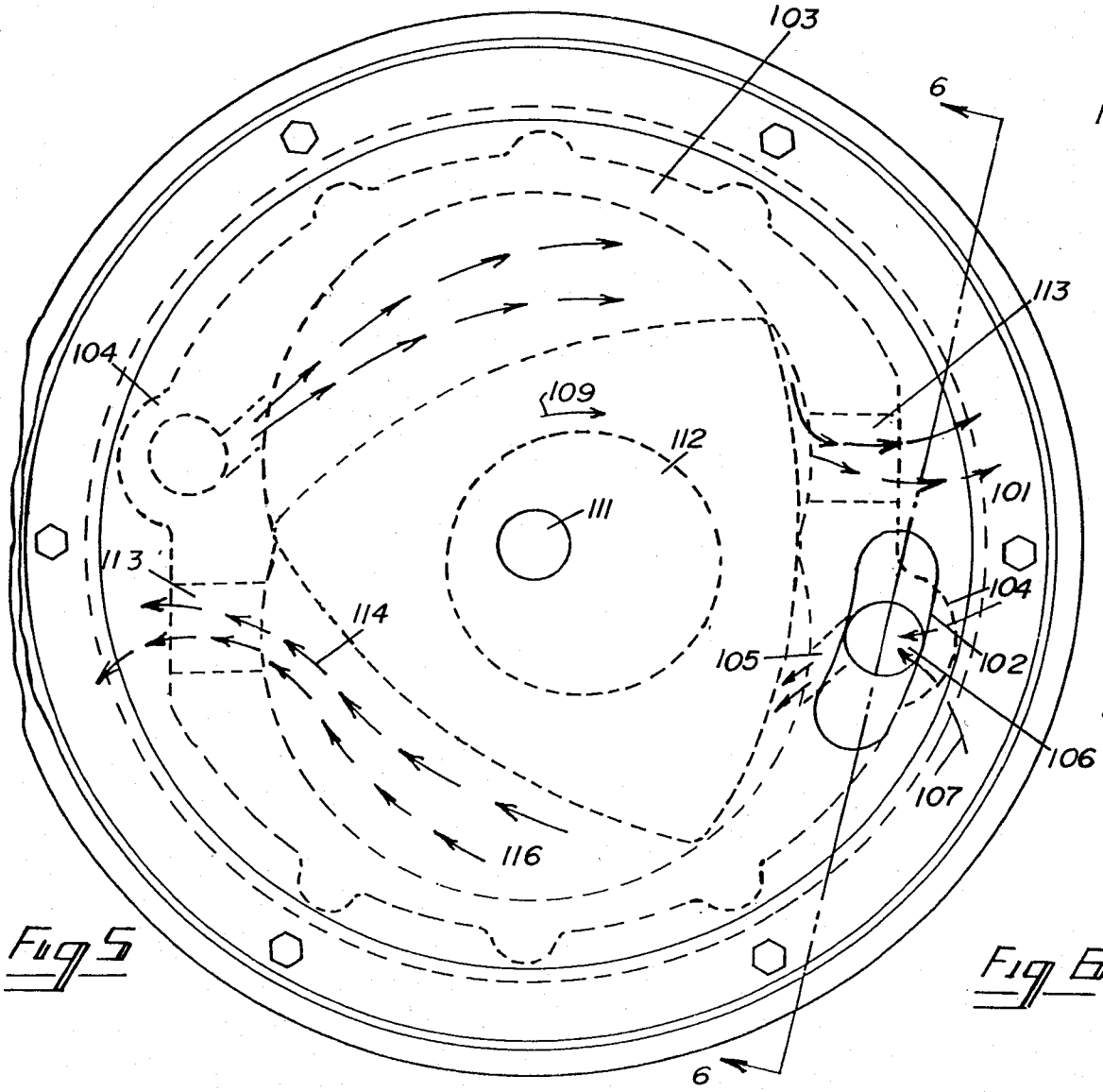
FIG. 5 is a cross section elevational view of another arrangement within the scope of the present invention.
Figure 7:
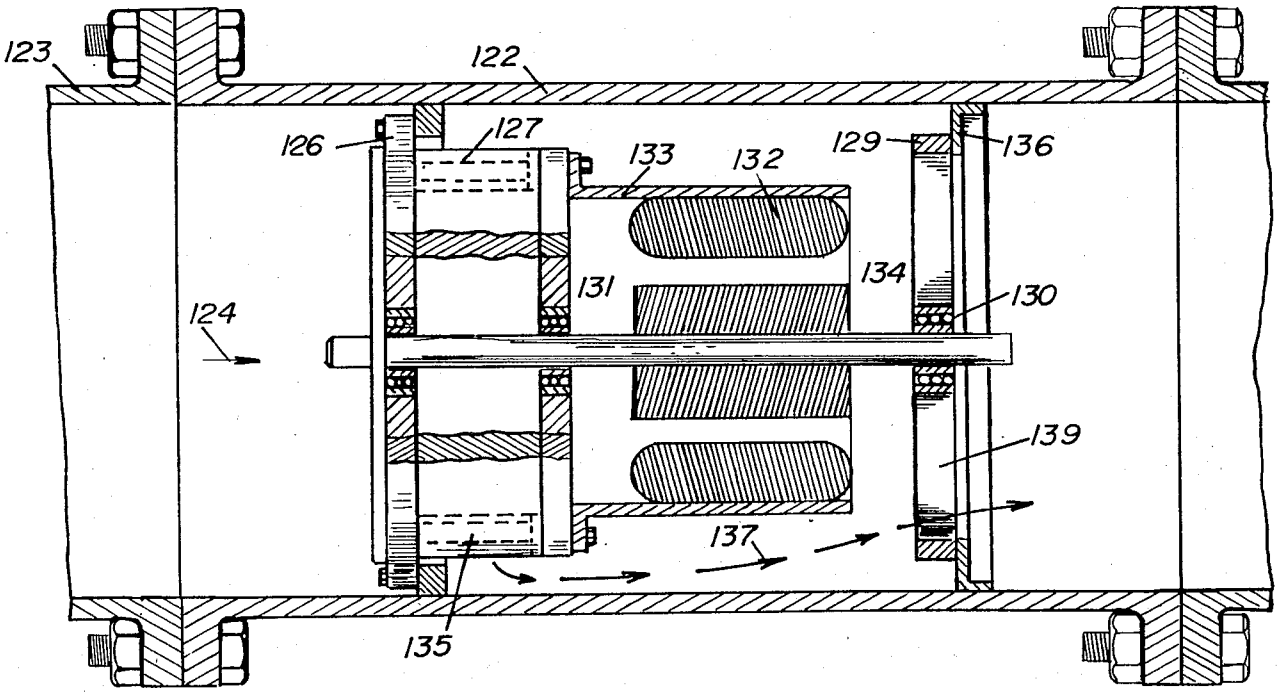
FIG. 7 is a cross sectional view of a generator device utilizing an expansion device within the scope of the present invention.

FIGS. 1 and 3A–3C illustrate one means for admitting gas to housing 1. Alternative means are illustrated in FIG. 5 as described hereinafter.

Within the scope of the present invention valve means are provided to selectively admit gas to housing 1 and to control the quantity of gas admitted.

A rotary valve member 51 is provided as shown to receive shaft 4 where a keyway 52 is provided in shaft 4 to mate with a keyway 53 of valve plate 51 where a key can be installed to lock the shaft to the valve plate so the valve plate rotates with the shaft.

Valve plate 51 can include a recess 54 to reduce frictional drag between the outer surface of wall 7 and the surface of plate 51. A slot 56 is provided in valve plate 51 to selectively admit fluid through the slot and through co-operative apertures 21,22 of end plate 21.

The epitrochoidal principal of operation is known in the art, rotor 3, in general includes an internal ring gear 24 and endwall 7 includes a planetary gear 10 of smaller diameter. The gears are located in cooperative relation to provide proper phasing between the rotation of shaft 4 the position of eccentric 5 and the rotation of rotor 3, to insure that the apices A, B and C of rotor 3 are in contact with a portion of the inner surface of epitrochoidal cavity 2 at all times during operation of the unit.

To maintain such contact the gears have a specific relationship one to another and a specified relationship to the eccentricity of the rotor. This relationship which is described in detail in the prior art for an epitrochoidal cavity with two lobes and a rotor with three apices requires specific pitch diameter of the inner ring gear, namely six times the eccentricity between the axis of shaft 4 and the axis of lobe 6 and the pitch diameter of the stationary gear 10 to be four times the eccentricity of the rotor. Also, as is known in the art the ring gear pitch diameter is $1\frac{1}{2}$ times the planetary gear pitch diameter and, thus, must include $1\frac{1}{2}$ times as many gear teeth. Accordingly, in operation the shaft 4 rotates faster than lobe 3 and in the arrangement shown the shaft 4 rotates three times faster than the speed of rotation of rotor 3.

Figure 3A:
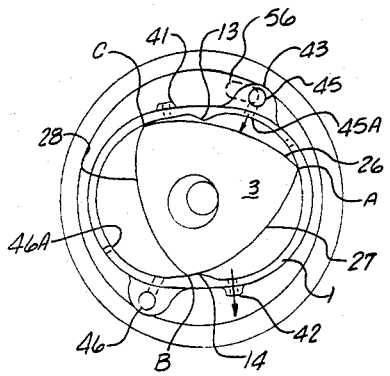
FIGS. 3A–3C are sequential examples of the operation of the device as shown in FIGS. 1 and 2.
Figure 3B:
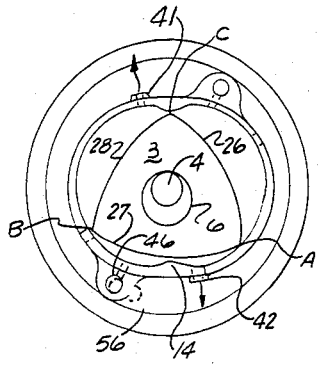
Figure 3C:
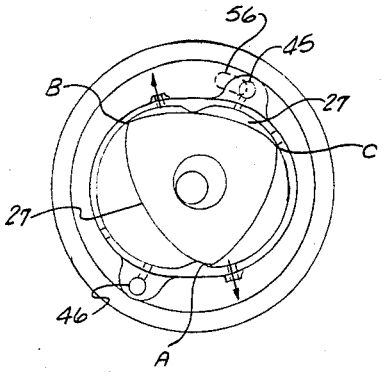

Accordingly in the arrangement shown, for every rotation of rotor 26 valve plate 51 will accomplish three rotations. This arrangement is illustrated in FIG. 3A–3C discussed hereinafter.

In operation of a device of the type shown in FIG. 1, clearances and sealing characteristics are of utmost importance. Most prior art devices have been designed to operate at specific ranges of higher temperatures. In accordance with the present invention it has been found that utilizing lower temperature gasses effective sealing can be accomplished by introducing sealing fluid or lubricant of selected viscosity temperature characteristics to the moving parts with elimination of the previously required complex seal and lubrication device.

FIG. 2 is a somewhat simplified cross-sectional diagram of an assembled unit taken along a plane passing diagonally through the device of FIG. 1 for purposes of showing orientation of elements as well as a lubrication system and sealing system within the scope of the present invention .

In FIG. 2 housing 19 is shown connected to endwall 7 by bolts 16 where aperture 21 of endwall 7 is in aligned relation with the aperture 45 of the lobe 43 and aperture 22 is in aligned relation with aperture 46 of lobe 44. Inlet ports 45A and 44A are shown communicating with the cavity defined by housing 1. Rotor 2 is shown in position defining a chamber 61 between the inner wall of housing 1 and a flank surface 2A of rotor 2. On the opposite side, rotor 2 is adjacent the inner wall 8 of the housing leaving only a slight clearance 62 therebetween. When rotor 2 is in a position where sealing is necessary as illustrated in FIG. 2 within the scope of the present invention it has been found useful to provide a sealing fluid to improve the efficiency of the operation of the unit as well as for lubrication and sealing.

In this regard an inlet 64 is provided through bearing 22, where O rings 33 are shown sealing shaft 4, which is shown in cross section. A conduit 66 is provided longitudinally through shaft 4 substantially as shown, communicating with a conduit 65, of shaft 4, to a groove 65A provided around the shaft to allow flow of fluid from inlet 64 to conduit 66 to conduit 65 from whence it flows through conduit 67 provided in valve plate 51. Conduit 67 communicates with the area between one side of wall 7 and the bearing surface 51A of rotary valve 51 to provide lubrication to the area and sealing for the area of contact. Another conduit 97 is provided to communicate with groove 96 which extends around shaft 4 and thereby with conduit 68 which, is connected with a groove 5A of eccentric 5 and V conduit 69 to supply fluid to the area 62 to provide lubrication and sealing to the unit to improve efficiency. Likewise conduit 70 is provided to communicate with a groove 69A to the inner surface of bearing 38 for lubrication and sealing.

The sealing/lubricant fluid admitted to the device can then be subsequently recovered in the exhaust gas and recycled through the unit. Viscosity of the fluid is the principal consideration in the selection thereof. An advantage of devices within the scope of the present invention is that the device can be utilized for multiple types of fluids by simply changing to sealing/lubricating fluid with different viscosity.

In the configuration shown in FIG. 2 slot 56 of valve plate 51 is located in aligned relation with inlet 21 so that in this position gas is being admitted to the device.

Another advantageous feature of the present invention is that different gas expansion ratios can be accommodated by varying the size of slot 56 in valve plates 51 because the residence time of the slot over gas inlets 45, 46 determines the quantity of gas admitted. In this regard it has been found that devices within the scope of the present invention compensate for change in the load applied to shaft 4 because increased load tends to slow the rotation of shafts 4 and plate 51 allowing additional gas to enter for expansion for decreased loading on shaft 4.

FIGS. 3A–3C illustrate operation of a device within the scope of the present invention.

In FIG. 3A the arrangement is shown in schematic end view where rotor 3 is in a position so that a chamber is formed between the flank surface 26 and the surface of the cavity formed by the housing 1. Valve plate 51 is a position where slot 56 is in alignment with aperture 45 so the gas flows into the chamber. It will be noted that sealing is obtained between lobe 13 and shank section 26 and apex A is sealed on the inner surface of the housing. Also gas is in the process of emission through outlet 42 from the cavity defined by shank 27. The chamber defined by shank section 28 is in expansion and because of the seal provided by apex C outlet 41 is not yet opened for emission of gas previously admitted to the chamber formed by shank section 28 and the inner wall of the cavity of housing 1.

In FIG. 3B the gas in the chamber between shank section 26 and the inner wall of housing 1 is in expansion, outlet 42 has not yet been opened because of the seal provided by apex C. Slot 56 is in a position to admit gas to the chamber formed by section 27 by means of inlet 46.

Outlet 41 has opened and gas is being emitted from the chamber defined by shank section 28.

In FIG. 3C shank section 27 has rotated past inlet 46, gas is being admitted to the chamber defined between shank section 27 and the inner wall of housing 1 with seals provided by apex B and apex A. Apex B is sealed on the inner surface so that the gas in the chamber between shank section 27 and the inner wall of the housing is in expansion. Likewise slot 56 has rotated to inlet 45 for a new charge of gas to a section defined by shank 27 and the wall of the housing.

Accordingly it can be seen that in the arrangement shown a valve plate having a single slot 56 can be utilized to accommodate the charging of all of the chambers defined by the shank sections of the rotor 2. It will be appreciated that the dimensions of slot 56 can be selected to determine the quantity of gas to be admitted to the unit for each charge and that by simply varying the position of the valve plate on the shaft or by utilizing valve plates having different length slots the speed and power generated by the device as well as the overall pressure drops through the device can be determined. In the arrangement shown shaft 4 makes three rotations (as does valve plate 51) for each rotation of rotor 3.

Figure 4:
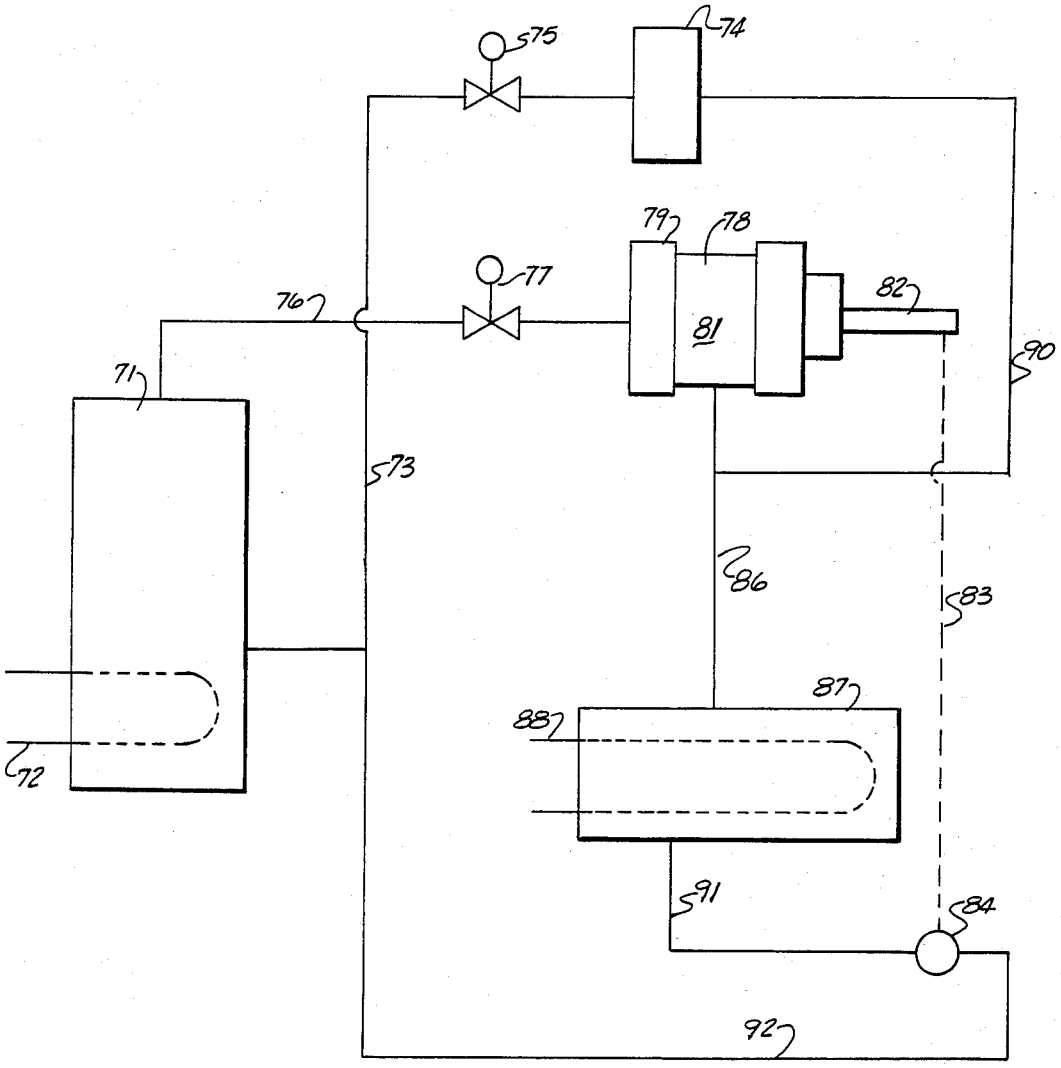
FIG. 4 is schematic of one system to utilize devices within the scope of the present invention.

FIG. 4 is a schematic diagram of one application of the device within the scope of the present invention to utilize waste heat as a source of new energy to the system in a closed cycle. In this regard waste heat boiler 71 is provided to receive a selected expansive compressable fluid such as Freon TM or other suitable expendable/compressible fluids as previously discussed. A heat exchanger 72 can be provided to receive heat which would otherwise be disgarded or otherwise used, to heat the fluid in boiler 71. An outlet 76 can be provided from boiler 71 to supply compressed pressurized heated fluid through a regulating valve 77 to a device 78 within the scope of the present invention as previously described. An inlet housing 79 is provided to receive the fluid and supply the fluid to the housing 81 shown. An outlet shaft 82 is provided to supply power and in the arrangement shown a connection 83 can be provided to a liquid pump 84 to be utilized in the operation of the system. Exhaust fluid from device 78 is provided by means of a conduit 86 to a condenser 87 adapted to receive a cooling medium, for example water or air, through a heat exchanger 88 to condense the working fluid. An outlet 91 is provided from condenser 87 to the inlet of pump 84 where a return 92 is provided from pump 84 to boiler 71.

As illustrated, the arrangement can also be adapted to provide cooling. In this instance the condensed fluid from pump 84 is supplied, by means of a conduit 73, which communicates with conduit 92, to an expansion valve 75 and an evaporator 74. Vaporized fluid from evaporator 74 is delivered to condensor 87 by conduits 90 and 90 for condensing and recirculation.

FIG. 5 is an illustration of an alternative arrangement for gas inlets. In FIG. 5 a valve plate 101 similar to valve plate 7 is shown having a gas inlet aperture 102 of selected length to control the relative length of time gas is admitted to the device.

Housing 103 similar to housing 1 is shown where inlet elements 104 are provided in generally diametrically opposed relationship each defining an inlet port 106 having a fluid directing outlet 105 to direct gas stream 107 in the direction of flow corresponding to the direction of rotation of a rotor 109 in housing 1 where rotor 109 rotates eccentrically about shaft 111 as previously described.

In accordance with one feature of the present invention it has been found that the direction of flow of the gas entering the housing can be important and that it is particularly useful to direct the gas in the direction of flow of the rotor to achieve improved efficiency of operation apparently because of the reduced flow resistance and because of the more uniform "filling" of the cavity defined by the rotor at the intake mode.

As shown, outlet ports 113 are provided for emission of fluid from the cavities such as cavity 116 formed between rotor 116 and housing 103.

Figure 6:
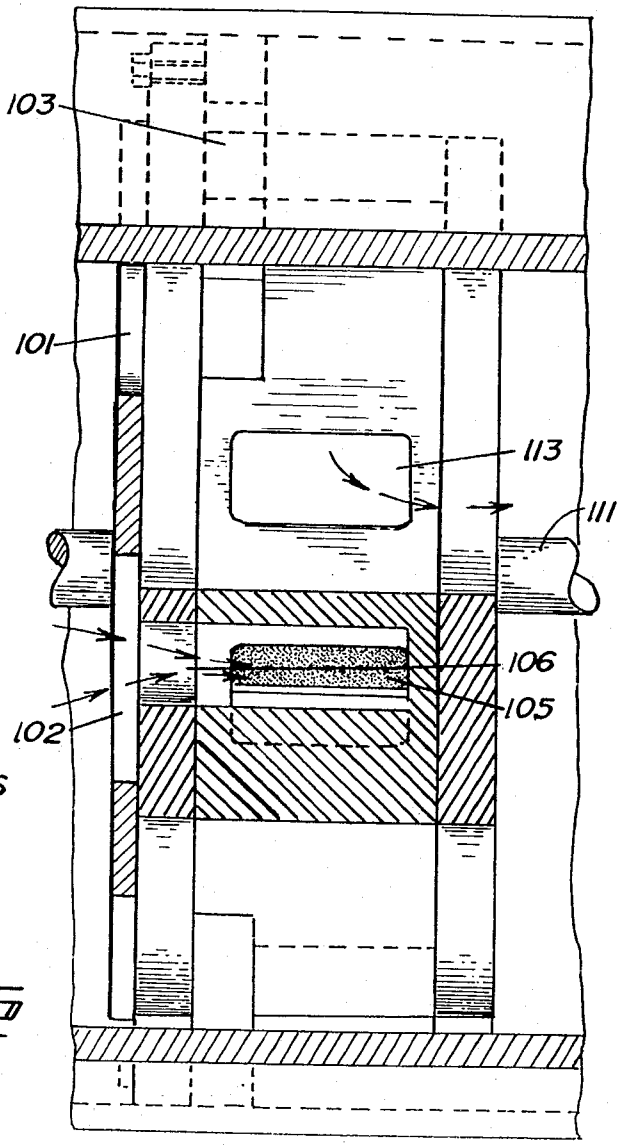
FIG. 6 is a view taken along a plane passing through line 6—6 of FIG. 5.

FIG. 6 is a sectional view illustrating that inlet port 106 is elongate and communicates with inlet 105 along the length thereof to facilitate admission of fluid to the device.

FIG. 6 is an illustration of another application of devices within the scope of the present invention where a trochoidal device 121 of the type shown in FIGS. 5 and 6 is located within a segment 122 of a pipe 123 where a gas 124 flows through the pipe.

Device 121 includes a collar 166 secured to a ring 127 located within segment 122 where the diameter of the opening of ring 127 is sufficient to allow passage of device 121 and a journal plate 1129 which journals the end of power shaft 131 rotated by device 121 to turn an electrical generator including stator 132 connected to device 121 by brackets 133 and armature 134 carried for rotation in the stator 132 to generate useful electricity which is removed from the device by the means known in the art and not shown.

Journal 129 including bearings 130 is carried by a ring 136 located in segment 122 when the gas flowing in pipe 123 enters device 121, causes rotation of shaft 131 and is emitted from outlets 135 of device 121 where the exhaust gas 137 flows through aperture 139 of journal assembly 129.

While the foregoing examples illustrate a closed system, it will be recognized that devices within the scope of the present invention are equally useful to provide shaft power in once through systems. For example, to obtain useful work in the expansion of natural gas when the reduced pressure is required for utilization of the gas and when the power generated by the device is utilized, for example to generate electrical energy.

It will be further recognized that the foregoing are but a few examples of arrangements of examples within the scope of the present invention and that various other arrangements also within the scope of the present invention will occur to those skilled in the art upon reading the disclosure set forth hereinbefore.

The invention claimed is:

1. A trochoid-type rotary piston gas expansion device including a stationary housing defining an epitrochoidal cavity, generally planar first and second end walls received by said housing on opposite sides of said cavity and having shaft aperture means in aligned relation on opposite sides of said housing where said cavity is symmetrical about a first axis transverse to said end walls, rotatable crank shaft means extending through said shaft apertures and said cavity parallel to said first axis and including an eccentric portion located on said shaft in said cavity, rotary piston means rotatably received on said eccentric portion of said crank shaft so that said axial centerline of said piston describes a circular path about the axis of said shaft in response to rotation of said crankshaft where said rotary piston includes at least three flank surfaces of generally equal length which intersect at apices to determine lines of sealing contact with said walls and housing of said cavity; and wherein said housing means and said rotary piston means include cooperative mating gear means to determine the speed of rotation of said piston means relative to said shaft means and where said rotary piston means accomplishes one revolution for every three revolutions of said shaft means; and first and second endwall inlets in the said first end wall located in generally diametrically opposed relation with respect to said axis of said shaft where said aperture means of said valve means periodically communicates with first one then the other of said first and second endwall inlets where said first and second endwall inlets communicate, respectively with first and second housing manifolds each having manifold outlet means communicating with said housing and gas outlet guide means to direct said compressible fluid into said expansion chambers defined between said trochoidal cavity and a flank surface of said piston, and in the direction of rotation of said piston means in a generally radial direction with respect to said first axis; outlet means provided in said housing for emission of fluid from said stationary housing when said piston is in selected position; source of pressurized gas; rotary valve means carried by said shaft means and located in contact with said side of one of said first and second end wall for rotation with said shaft having aperture means therein communicating with said source of pressurized gas to be selectively aligned with said inlet means by rotation of said shaft means to selectivly open and close said inlet means to selectively admit gas to said expansion chambers in accordance with the position of said piston surfaces.

2. The invention of claim 1 wherein said shaft means includes first internal fluid conduit means extending generally longitudinally along a portion of the length of said shaft with at least two radially extending second conduit means communicating with said first conduit means to conduct fluid to the circumferential surface of said shaft and including fluid supply means to supply fluid to one of said second conduit means whereby fluid is admitted from at least one of said second conduit means.

3. The invention of claim 2 wherein one of said second conduit means for emission of fluid is located to direct fluid to the area engagement between said valve means and said first endwall.

4. The invention of claim 3 wherein said rotary piston includes radially extending piston conduit means each having an inlet communicating with one of said second conduit means for emission of lubricating and seal liquid and has an outlet for emission of said liquid to said apices of said rotary piston means to provide a seal between said apices and said housing.

5. The invention of claim 2 wherein at least one of first and second endwall means shaft aperture includes bearing means to receive said shaft means and where said second conduit means are located to supply fluid to said bearing means.

6. The invention of claim 1 includiing a source of heat; a working heat vaporizable fluid, boiler means to receive said vaporizable fluid and heat from said heat source to vaporize said fluid, an outlet to supply said vaporized fluid to said inlet means, and a fluid inlet; condensor means to receive said vaporizable fluid from said outlet means, cooling means to condense said vaporizable fluid and a condensor outlet and pump means communicating with said condenser outlet and said boiler means inlet to supply said condensed vaporizable fluid to said boiler.

* * * * *